US009862224B1

(12) United States Patent
Maresh

(10) Patent No.: US 9,862,224 B1
(45) Date of Patent: Jan. 9, 2018

(54) WRITING INSTRUMENT WITH SPOOL VALVE

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 177 days.

(21) Appl. No.: 14/799,366

(22) Filed: Jul. 14, 2015

(51) Int. Cl.
*B43K 5/18* (2006.01)
*B43K 5/02* (2006.01)

(52) U.S. Cl.
CPC ..... *B43K 5/1827* (2013.01); *B43K 5/02* (2013.01)

(58) Field of Classification Search
CPC combination set(s) only.
See application file for complete search history.

(56) References Cited

U.S. PATENT DOCUMENTS 1,978,675 A * 10/1934 Kingman ..... B43K 5/18 401/194
3,807,880 A * 4/1974 Munz ..... B43K 1/00 401/265
2002/0192007 A1* 12/2002 Lee ..... B43K 5/1854 401/117

* cited by examiner

*Primary Examiner* — David Walczak
(74) *Attorney, Agent, or Firm* — Nick A Nichols, Jr.

(57) ABSTRACT

A writing instrument includes an elongated body housing a spool valve and a writing tip secured to a distal end of the elongated body. Two or more fluid reservoirs in selective fluid communication with the writing tip. Axial movement of the spool valve relative to the elongated body of the writing instrument alternately establishes fluid flow paths between the fluid reservoirs and the writing tip.

14 Claims, 10 Drawing Sheets

WRITING INSTRUMENT WITH SPOOL VALVE

BACKGROUND

The present invention relates to writing instruments, and in particular to writing instruments utilizing colored inks, pigments, and/or dyes in a suspended fluidic state.

When dealing with writing fluids such as inks, paints, dyes, and/or pigments, subtractive color theory applies, as opposed to additive color theory where a light source passes through colored filters. Subtractive color theory is that of mixing inks, paints, dyes and/or other natural pigments to make colors that absorb and reflect particular wavelengths of light. For example, for printing, cyan, magenta, and yellow are primary colors. Black may be added for various reasons in a four color process, most importantly because cyan, magenta, and yellow do not produce "pure" black but more of a dark gray.

Subtractive color theory is based on what light is absorbed. The amount of any color showing will depend on the amount of each of the three primary colors is in a color mixture. Cyan is the opposite of red. Magenta is the opposite of green. Yellow is the opposite of blue. The amount of blue in the final color mixture is directly related to the amount of yellow ink that is in the color mixture. The same is the case for other primary colors. For example, orange is a common color that is generally equal amounts of red and yellow. Adding more yellow will create a lighter orange. Adding more red will create a red orange. Green color is a combination of cyan and yellow.

The subtractive color theory starts with the presence of all colors of light, usually as white light reflected from a white surface, such as paper. Dyes or inks may be used to subtract some of the reflected light. Understanding subtractive color theory requires an understanding of how colors of light are subtracted. If yellow dye or ink is applied on a white sheet of paper, one may think that color is added to the paper, but the color is already there; the white paper reflects all colors of light approximately equally. The yellow ink, however, reflects only red and green light and absorbs blue light, thereby subtracting it from the white light. Any color of ink, dye or paint subtracts its complementary color of light. Cyan ink on white paper absorbs red light, and allows green and blue to be reflected. Magenta ink subtracts green light, and allows red and blue to reflect. Yellow ink absorbs blue light, allowing red and green to reflect. Cyan, magenta and yellow are the subtractive primary colors, and combined in pairs, they produce the colors red, green and blue. When all three primary colors are subtractively combined, they subtract all colors of light, leaving black, typically a dark gray is the practical result.

When two primary colors are overlaid, they each subtract one color, allowing only the third color to be reflected. For example, if magenta and yellow ink are mixed or applied on white paper, the magenta ink absorbs green light. The yellow ink subtracts blue light. Neither of them absorbs red light, so red light is reflected by white paper, and a viewer sees the color red. In a sense, the colors experienced in a subtractive color mixture are created in the same way they're created with an additive mixture. A combination of red and green light (where the red and green colors each contain light from one-third of the spectrum) will always produce a yellow-colored light (containing light from two-thirds of the spectrum). It doesn't matter whether one starts with white light and subtracts one-third of the spectrum, or starts with no light (black) and adds two thirds of the spectrum. Similarly, green and blue light always combine to produce cyan-colored light, and red and blue light always combine to produce magenta-colored light. Complementary colors work in similar ways for both additive and subtractive mixtures. In additive mixtures for example, yellow and blue light combine to complete the spectrum, producing white light. In subtractive mixtures, however, yellow and blue produce black (yellow and cyan produce green). Yellow ink subtracts one-third of the spectral light, blue ink subtracts the other two-thirds of the light, resulting in a black color. As previously noted, black is difficult to achieve in the subtractive process, and for that reason a four color process may be desired in some situations in order to achieve a true black color.

In summary, the subtractive color system involves colorants and reflected light. Subtractive color starts with an object (often a substrate such as paper or canvas) that reflects light and uses colorants (such as inks, pigments or dyes) to subtract portions of the white light illuminating an object to produce other colors. If an object reflects all the white light back to the viewer, it appears white. If an object absorbs (subtracts) all the light illuminating it, no light is reflected back to the viewer and it appears black.

SUMMARY

A writing instrument may include an elongated body housing a spool valve, fluid reservoirs, and a writing tip secured to the elongated body in selective fluid communication with the fluid reservoirs. The spool valve may be axially moveable relative to the elongated body of the writing instrument.

In one instance an object of writing instrument described herein is to provide a low cost variable color writing instrument capable of full spectrum color.

In another instance an object of the writing instrument described herein is to maximize the words, characters and the like written with the writing instrument before refilling the writing fluid in the fluid reservoirs, and whereby, for example, a user may write in excess of 100 times more words, characters and the like with a given amount of writing fluid, as compared to existing writing instruments.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

As used herein the term "fluid" means inks, paints, dyes, pigments, water, alcohol, mixing solutions, surfactants and other flowable fluids suitable for marking on a substrate material, such as paper and the like.

Figure 1:
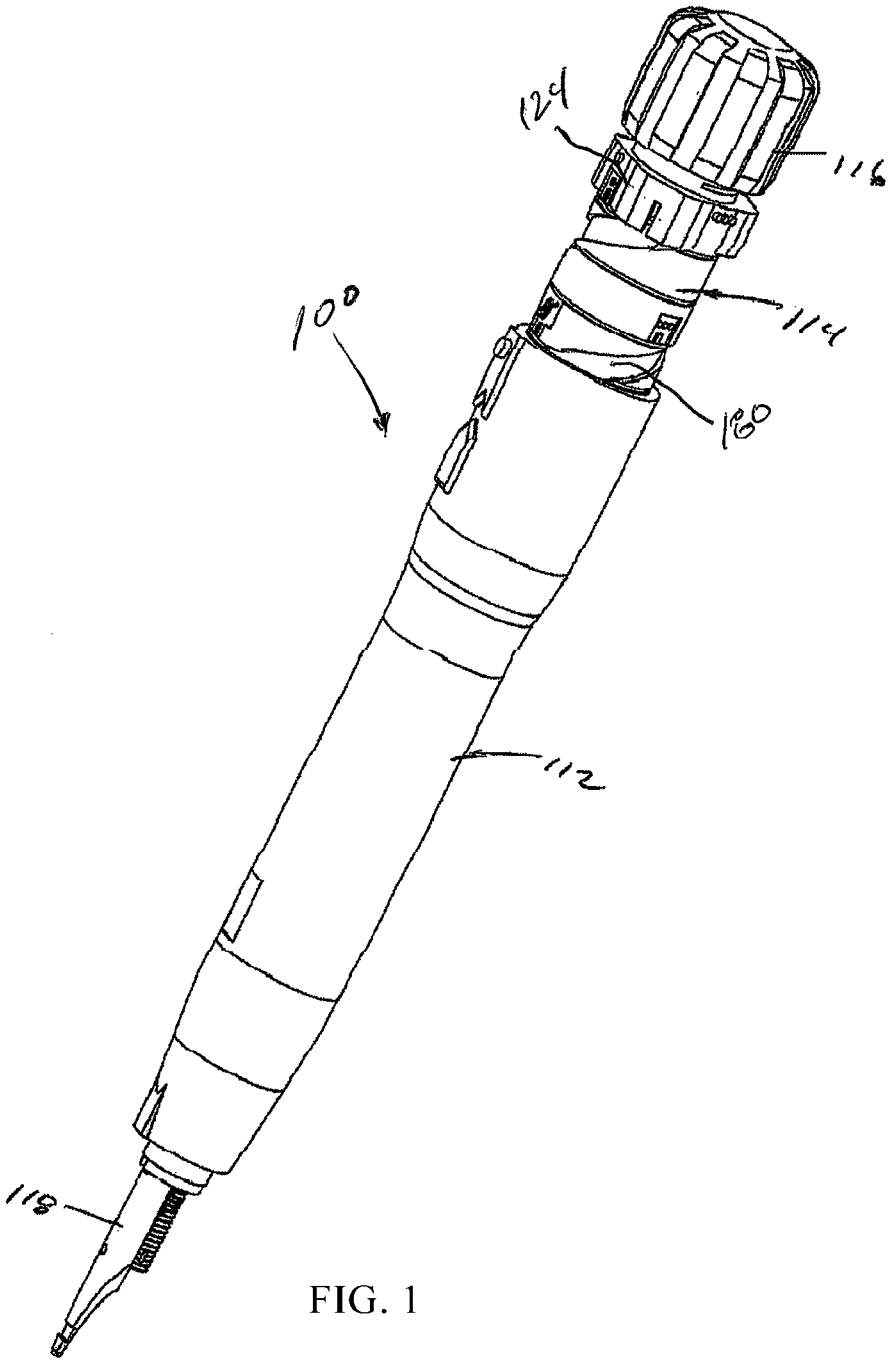
FIG. 1 is a perspective view of a writing instrument.

Referring first to FIG. 1, a writing instrument is generally identified by the reference numeral 100. For purposes of illustration, but not by way of limitation, the writing instrument 100 is depicted in the drawings as a "fountain pen" and will hereinafter be referred to as a "pen."

Figure 2:
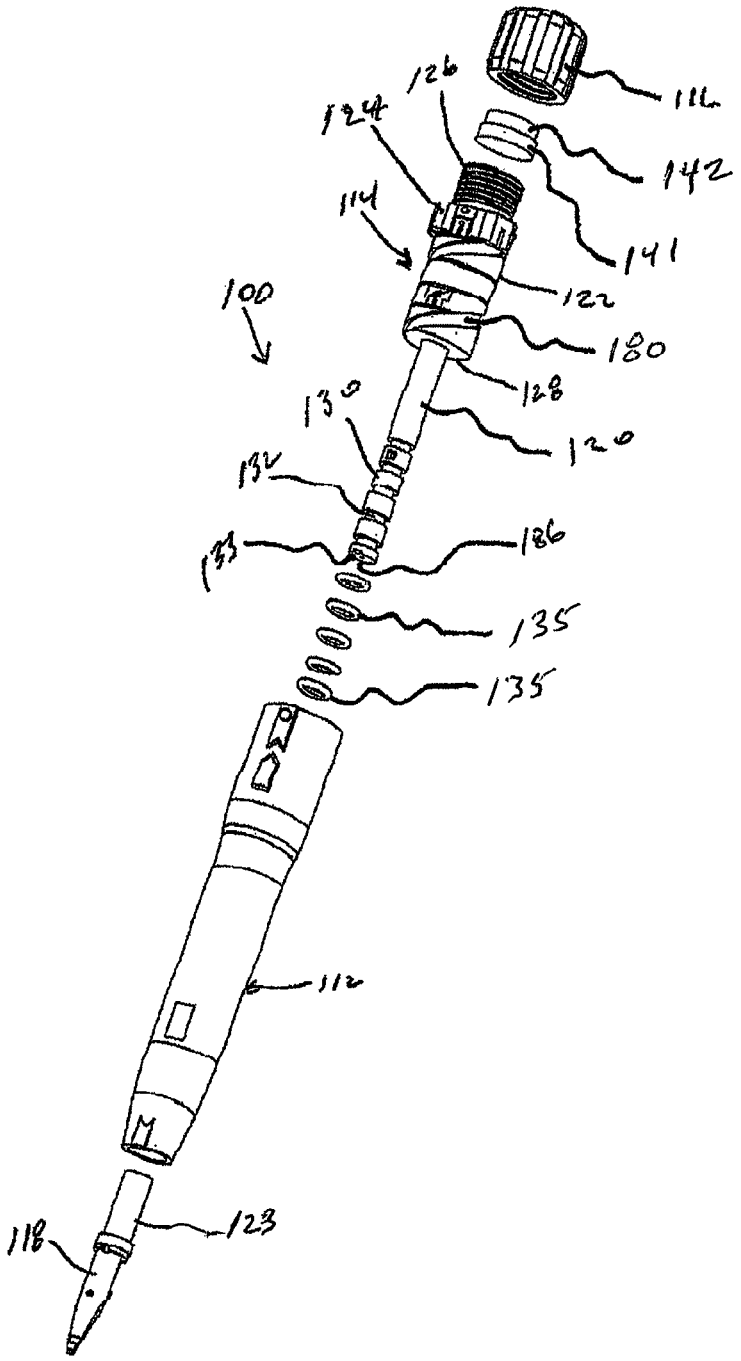
FIG. 2 is an exploded perspective view of the writing instrument shown in FIG. 1.

The pen 100 may include a pen barrel 112, a spool valve 114, a cap 116 and a writing tip or nib 118. The spool valve 114, shown in the exploded view of FIG. 2, may include an elongated stem 120, a head 122 and a threaded distal end 126. The head 122 may include a griping portion 124, for example a thumb grip. The stem 120 extends downwardly from a lower transverse wall 128 of the head 122. The stem 120 may be integrally formed with the head 122 or fixedly secured to the head 122 by means known in the art. A lower portion of the stem 120 may include lands 130 and circumferential grooves 132 axially spaced along the lower portion of the stem 120. O-rings 135 may be concentrically and axially constrained in the grooves 132. The stem 120 terminates at a lower distal end defined by a transverse wall 133.

Figures 3A, 3B, 3C:
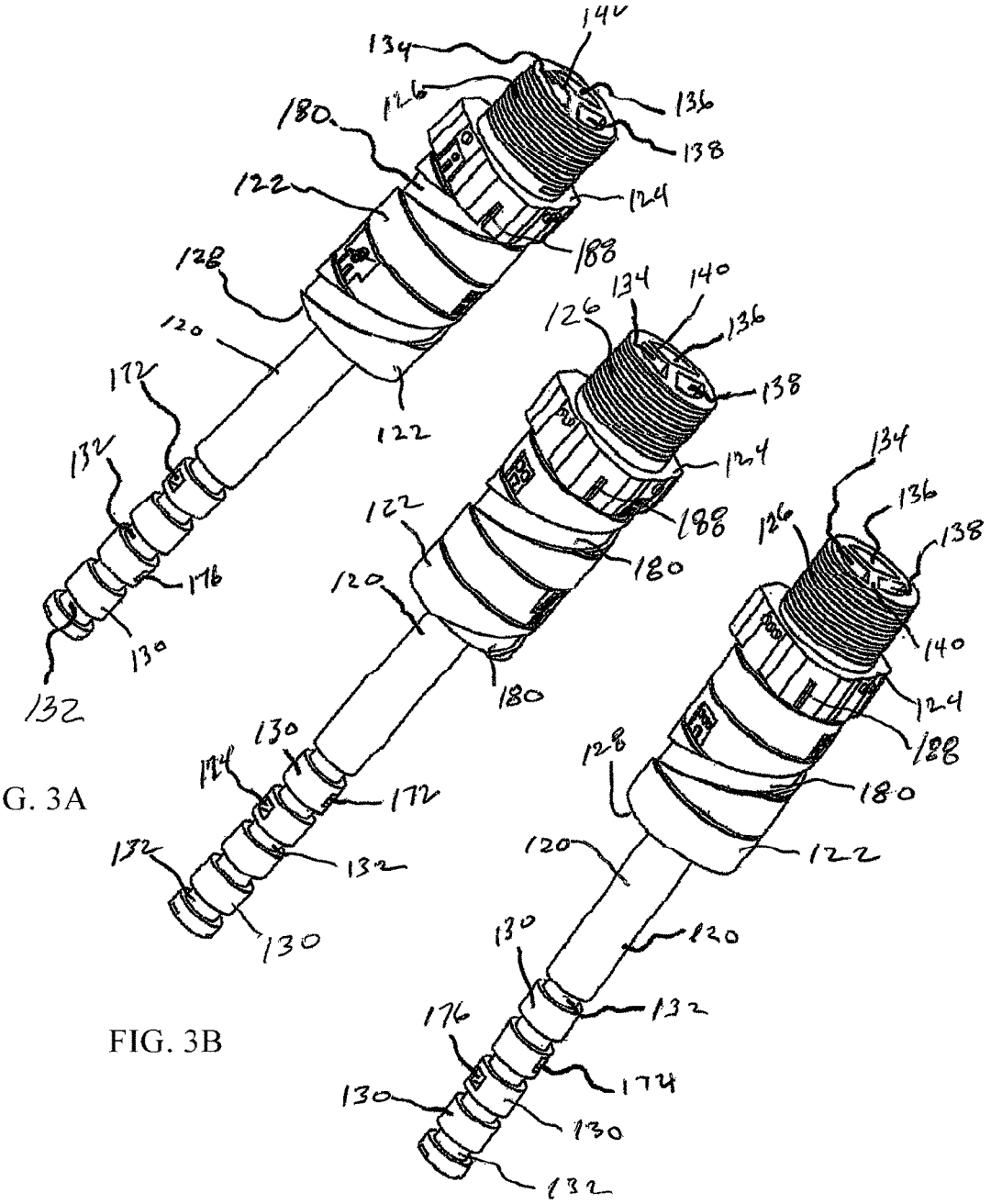
FIGS. 3A-3C are perspective views of the spool valve of the writing instrument shown in FIG. 1.

The head 122 of the spool valve 114 may include two or more fluid reservoirs. The pen 100 shown in FIGS. 3A-3C depicts three reservoirs 134, 136 and 138, for illustrative purposes only and not by way of limitation. The reservoirs 134, 136, 138 are separated by walls 140 and extend from the distal end 126 of the spool valve 114 downward into the head 122, terminating at a transverse wall 142 depicted in phantom in FIG. 5.

The reservoirs 134, 136, 138 may be sealed by the cap 116 threadedly secured on the distal end 126 of the spool valve 114. A flexible washer 141 and a rigid washer 142 in the cap 116 ensure an air and liquid tight seal for the reservoirs 134, 136, 138.

Figure 4:
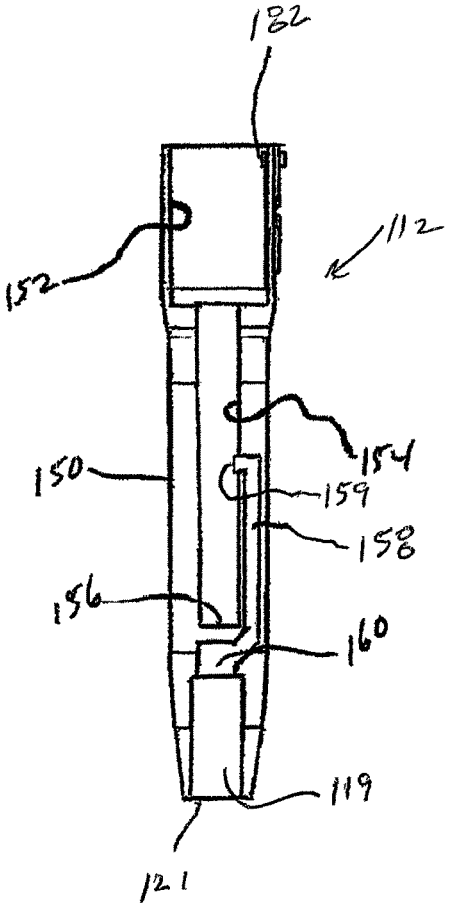
FIG. 4 is a section view of the elongated body of the writing instrument shown in FIG. 1.
Figure 6:
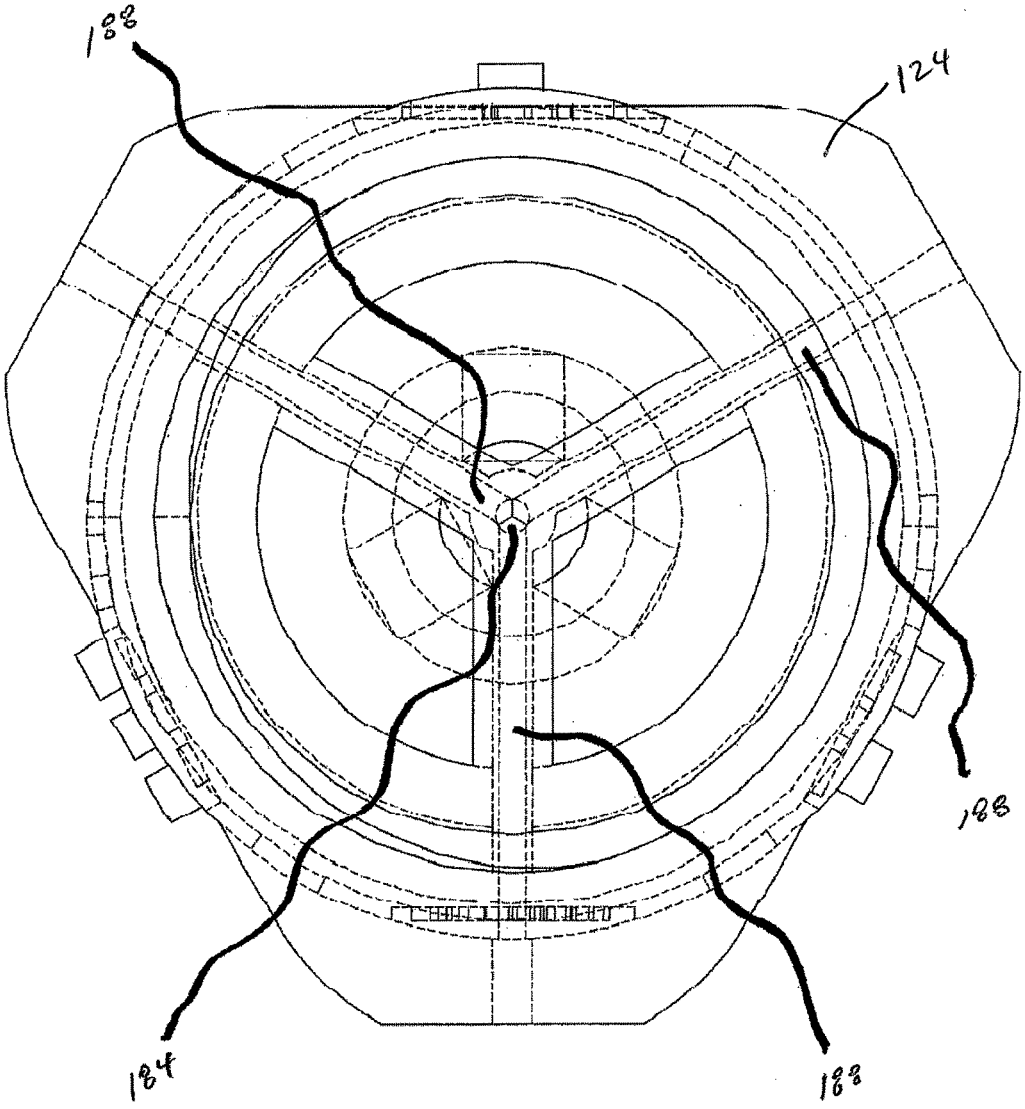
FIG. 6 is a top view of the writing instrument shown in FIG. 1 with hidden lines shown in phantom.

Referring now to FIG. 4, the barrel 112 of the pen 100 may, for illustrative purposes, but not by limitation, include an elongated substantially cylindrical body 150. The upper end portion of the body 150 includes a box end or receptacle 152 sized and configured to receive the head 122 of the spool valve 114. A borehole 154 concentric with the vertical axis of the body 150 extends axially downward from the receptacle 152 to a transverse bottom wall 156. The upper end of the borehole 154 opens to the interior of the receptacle 152. The borehole 154 is sized and configured to receive the stem 120 of the spool valve 114. Upon assembly of the barrel 112 with the spool valve 114, the o-rings 135 seal against the inner surface of the borehole 154 isolating the lands 130 from one another.

The pen barrel 112 may include a conduit 158 establishing a fluid pathway between the borehole 154 and a mixing chamber 160 proximate the lower distal end of the barrel 112. An axial passage 119 may extend from the mixing chamber 160 to the distal end 121 of the pen barrel 112. The passage 119 is configured to receive the connector end 123 of the nib 118. The nib 118 may be screwed or press fit into the passage 119 thereby securing the nib 118 to the lower distal end of the pen barrel 112. The upper end of the passage 119 is open to the mixing chamber 160, thereby establishing fluid communication between the mixing chamber 160 and the nib 118.

Figure 5:
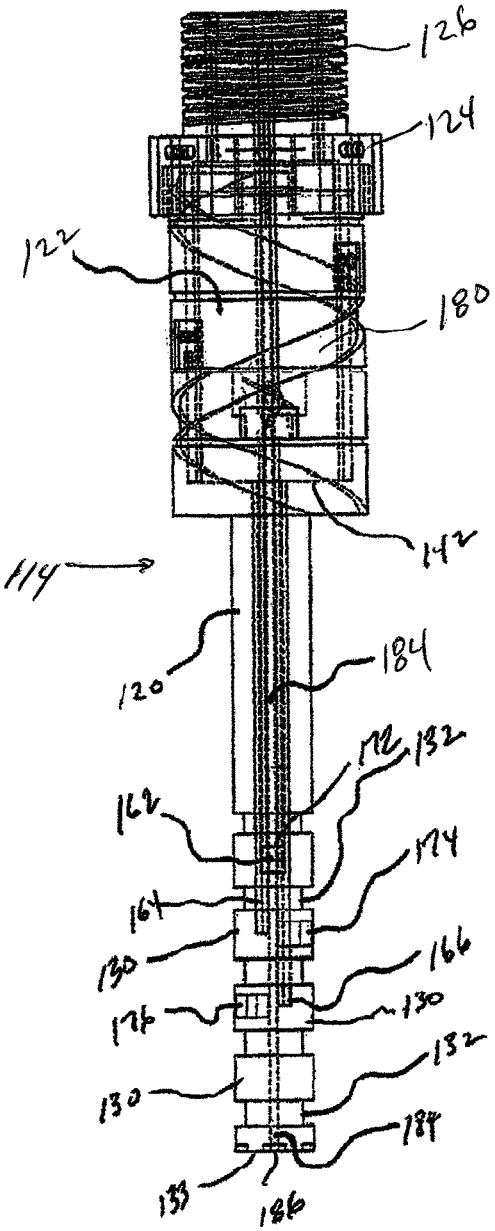
FIG. 5 is a side view of the spool valve of the writing instrument shown in FIG. 1 with hidden lines shown in phantom.

Referring now to FIG. 5, the spool valve 114 may include one or more conduits for establishing fluid communication between the reservoirs 134, 136, 138 and the nib 118. In FIG. 5, conduits 162, 164 and 166 are shown offset from the central vertical axis of the stem 120 and extend substantially parallel to the central axis of the stem 120. The conduits 162, 164, 166 terminate at radially and outwardly directed openings 172, 174, 176 in the lands 130. Clearance between the lands 130 and the borehole 154 is sufficient for fluid to flow therebetween. However, it is understood that other configurations, such as a concentric groove, may be provided about the lands 130 to allow circumferential fluid flow (ink or solvent and the like) about the lands 130.

The pen 100 may be assembled by inserting the stem 120 into the borehole 154 of the barrel 112. The head 122 may include a helical groove 180 in the outer surface thereof sized to receive a boss 182 projecting inwardly proximate the open distal end of the receptacle 152. The boss 182 is constrained to move along the helical groove 180 upon rotation of the spool valve 114 relative to the barrel 112. Rotation moves the spool valve 114 axially relative to the barrel 112. The thumb grip 124 provides a convenient surface for grasping and rotating the spool valve 114 clockwise or counter clock-wise to advance or retract the spool valve 114 from the pen barrel 112. For the configuration of the pen 100 illustrated in FIGS. 1-7, clock-wise rotation moves the spool valve 114 axially downward relative the barrel 112. Counter clock-wise rotation moves the spool valve 114 axially upward relative the barrel 112. It should be noted that the barrel 112 may likewise be rotated by holding the spool valve 114 and rotating the barrel 112 to move it axially relative to the spool valve 114.

Referring still to FIG. 5, the spool valve 114 may include a vent duct 184 having a lower distal opening 186. The vent duct 184 may be concentric with the central vertical axis of the spool valve 114. The vent duct 184 may extend axially through the spool valve 114 from the opening 186 at the lower distal end of the stem 120 and vent to the atmosphere through radially outwardly directed air vents 188 in the spool valve head 122, shown in FIG. 6. The vent duct 184 generally functions as a relief valve to release air that may be compressed in the barrel borehole 154 as the stem 120 advances downward in the borehole 154. Venting air out of the borehole 154 may avoid air pressure fluctuations that may interfere with fluid flow from the reservoirs 134, 136 138 into the conduit 158.

Fluid may be distributed to the pen nib 118 upon alignment of the upper open end 159 of the conduit 158 with openings 172, 174, 176 in the stem 120. As previously noted, rotation of the spool valve 114 moves the stem 120 axially relative to the barrel borehole 124. FIGS. 7A-7D illustrate the location of the stem 120 relative to the upper open end 159 of the conduit 158 for distributing fluid from the reservoirs 134, 136, 138 to the pen nib 118.

Figure 7A:
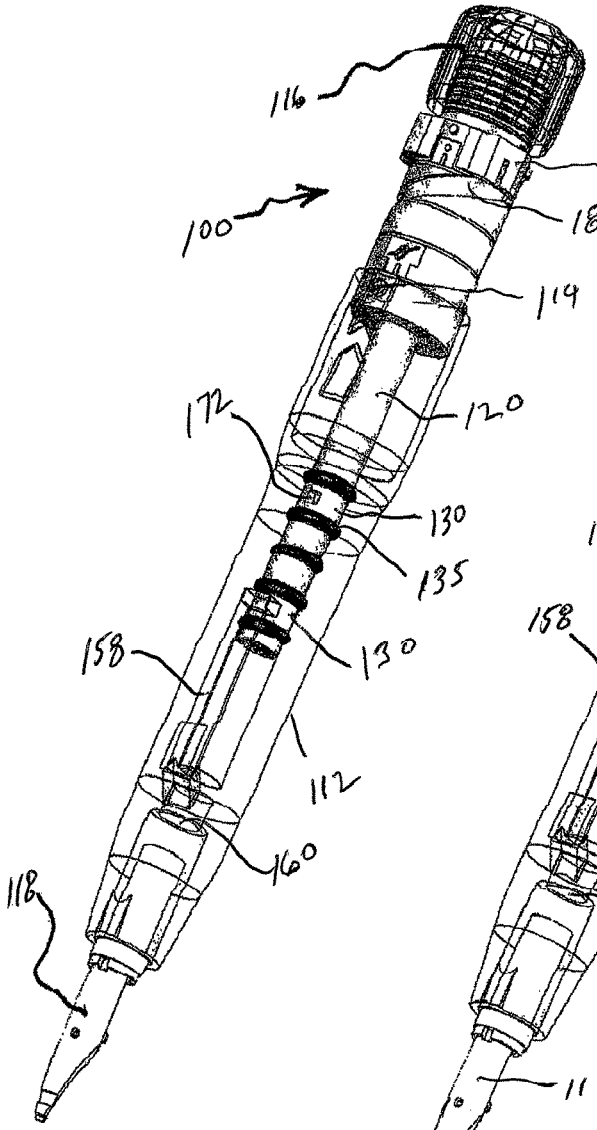
FIGS. 7A-7D are perspective views of the writing instrument shown in FIG. 1 depicting various axial positions of the spool valve relative to the elongated body of the writing instrument.

FIG. 7A depicts the pen 100 in the "off" or non-writing mode. In this mode, the spool valve 114 is depicted as being retracted from the pen barrel 112 to a position so that the lowermost land 130 blocks the opening 159 of the conduit 158. The lowermost land 130 is not in fluid communication with any reservoir and therefore no fluid is distributed to the pen nib 118.

Figure 7B:
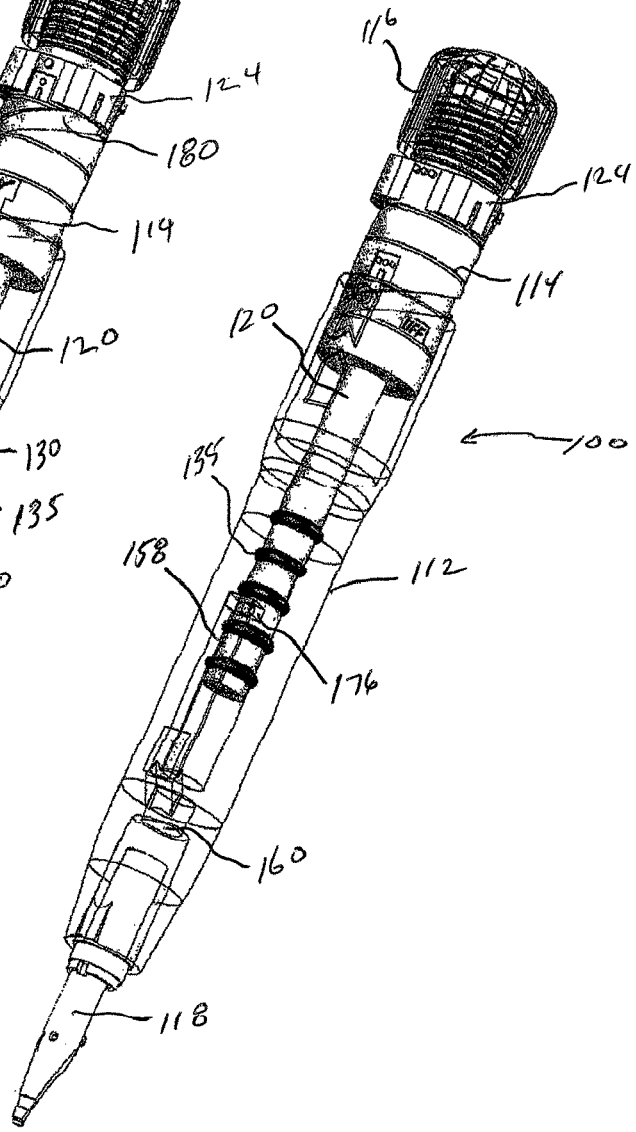
Figure 7C:
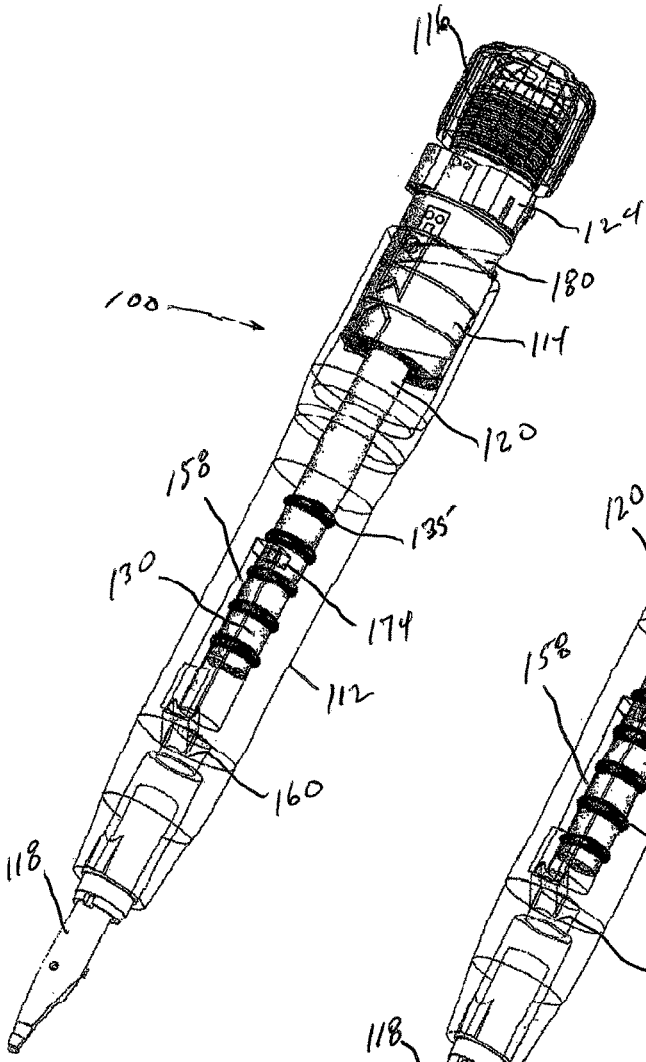
Figure 7D:
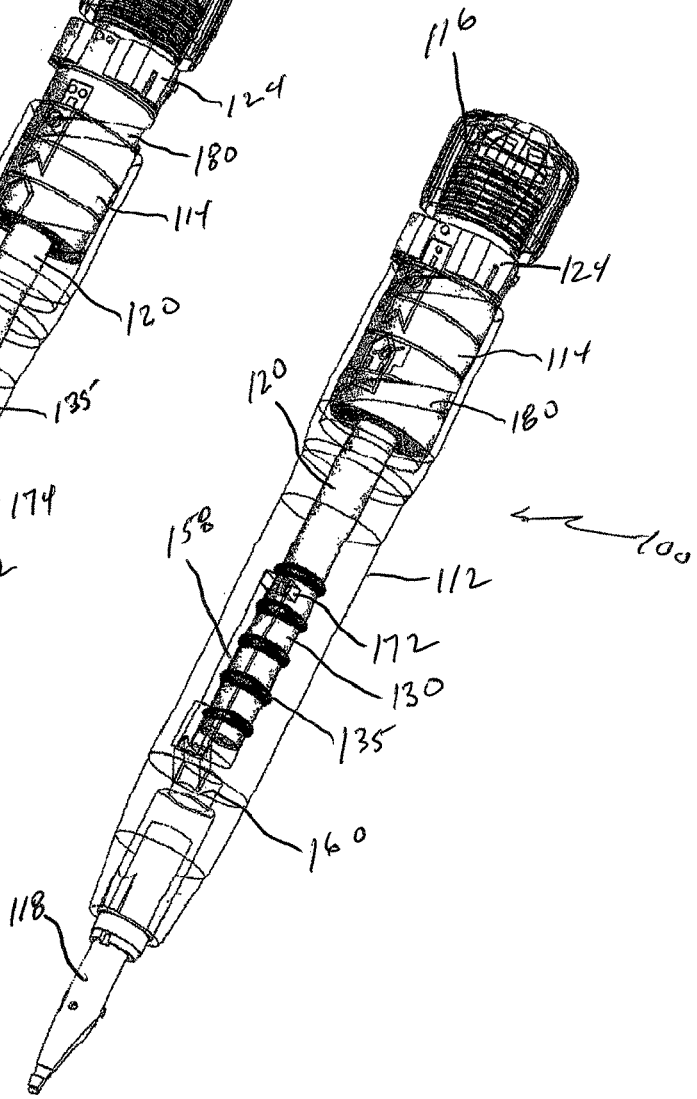

FIGS. 7B-7D depict the pen stem 120 positioned so that the opening 159 of the conduit 158 aligns with the openings 176, 174, 172 in the lands 130, thereby establishing fluid communication between a respective reservoir 134, 136, 138 and the pen nib 118. A user may actuate the spool valve 114, as desired to distribute a writing fluid from the fluid reservoirs 134, 136, 134 to the mixing chamber 160 of the pen barrel 112. The user may change the color, shade and hue of the writing fluid applied to the writing surface in an infinite combination of colors and duration of fluids distributed to the mixing chamber 160 from the fluid reservoirs 134, 136, 138.

The writing instrument, as noted above, depicted in the drawings is a fountain type pen for illustrative purposes only. It is understood that the writing instrument described herein may include, but is not limited to, ball point pens with viscous ink (considered paste), pens with generally decreasing ink viscosity ranging from tempura pens, gel pens, roller ball pens, brush tip pens, fountain pens, stylus pens, and/or felt tip pens, of both water or alcohol base and the like.

The pen 100 may be suitable for a wide range of uses such as a simple novelty item to being able to continuously and smoothly cause a transition of colors while creating a drawing, sketch and the like, and where no two sketches or drawings are identical, even with identical pen motions, because of the somewhat turbulent flow and the complex nature of the physics of a flowing fluid. Viscosity alone is a complex and somewhat chaotic factor to consider, as well as the dynamics of the spool valve or other valves, such as disk valves or pinch valves.

The subtractive color system, described in greater detail hereinabove, applies to the pen 100. The full color spectrum may be possible with the ink colors magenta, yellow, and cyan. Generally, pen 100 may be considered a "color shifting pen" utilizing three reservoirs (or three cartridge) of compatible or mixable inks. Color shifting pens may be controlled with the spool valve described hereinabove. The pen 100 may be used for various purposes, such as, notarizing documents or dealing with legal matters, or even writing a diary. The chronological order of the written words, characters and the like may be determined by the ink color. If insertions occur out of sequence, the color of such insertions provides an indication as to the general time period, based upon the ink color, that such insertions were made. In this respect, the use of color may greatly assist in the prevention of fraud and forgeries. Note that it would be very difficult to re-blend the identical ink color. Forensic document examination may also be greatly facilitated. The reader will note that the chronological order is not actually a function of time, but rather a function of the number of words, characters and the like the pen has written. Furthermore, in addition to ink, fluorescent dyes which fluoresce under ultraviolet light may be introduced into one or more of the reservoirs, for example, in order to introduce unique graduations which would only be visible under UV light.

Continuing again with ink mixtures, the ink colors throughout a sketch, drawing or writing are a smooth transition of many colors, hues, and shades. A user may create the sketch or drawing while controlling and anticipating the colors being mixed and/or blended and delivered to the writing tip. For example, while shades of yellow are being delivered to the writing tip, the sun or yellow objects may be sketched, and as the user introduces green blended ink, then plants and/or green objects may be sketched. Furthermore, during color mixing, and particularly when utilizing fountain pens, it should be noted that the quantity of ink colors available in the market is high, and the user may elect to deviate from the three subtractive primary colors discussed above and select non-primary colors which, for example, may result in mixtures of pastel colors. Alternatively, scarlet, purple and/or green ink may be included in at least one of the reservoirs to emphasize a particular mixable range of colors. Also, for steady delivery of a mixed color or shade, positioning the spool valve to a predetermined intermediate position between two fluid reservoirs, both in the "on" mode in some portion (throttling), steady state mixing action may occur while writing.

All colors are possible with the three reservoir configuration of the pen 100 where the primary subtractive colors are provided. With regard to secondary colors, if the primary subtractive colors of yellow, cyan, and magenta are provided, then a secondary color such as red, green or blue may be mixed and delivered to the pen mixing chamber, and once such a color is in the mixing chamber, a new primary color may be introduced resulting in colors such as violet, rose, orange, chartreuse green, spring green, and azure to be mixed within the pen mixing chamber and thereafter delivered to the writing tip. Further variations when combining tertiary and secondary colors, or tertiary and tertiary colors, or any combination of the above colors are also possible, thus enabling a remarkably wide variation of the number of colors, shades and hues which may be gradually mixed within the pen mixing chamber during the act of writing.

Figure 8:
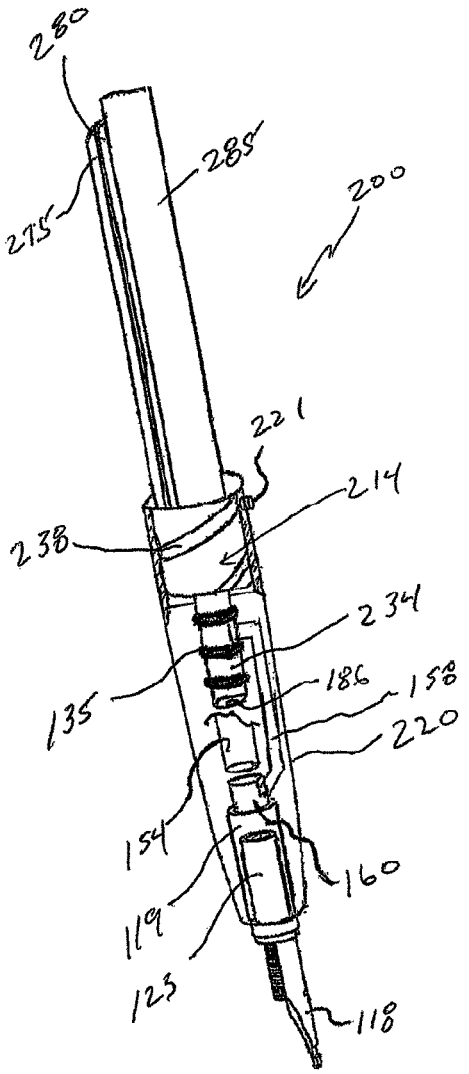
FIG. 8 is perspective view of a second embodiment of a writing instrument.
Figure 9:
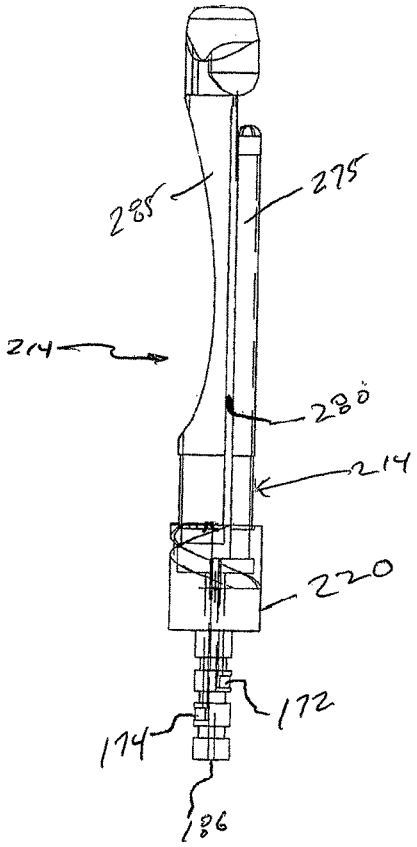
FIG. 9 is a side view of spool valve of the writing instrument shown in FIG. 8 depicting a flexible wall of a fluid reservoir pressed against a rigid member mounted on the spool valve.
Figure 10:
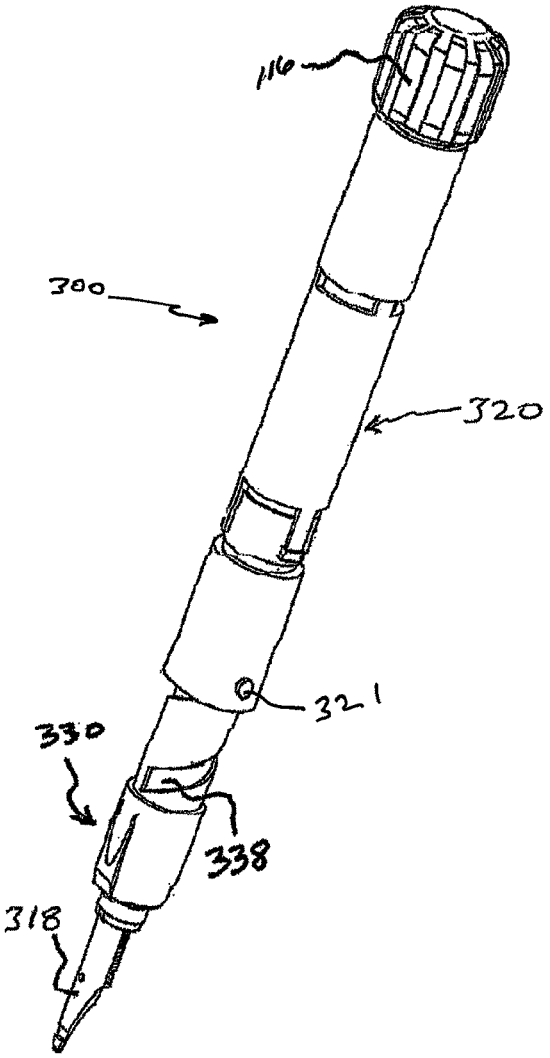
FIG. 10 is a perspective view of a third embodiment of a writing instrument.
Figure 11:
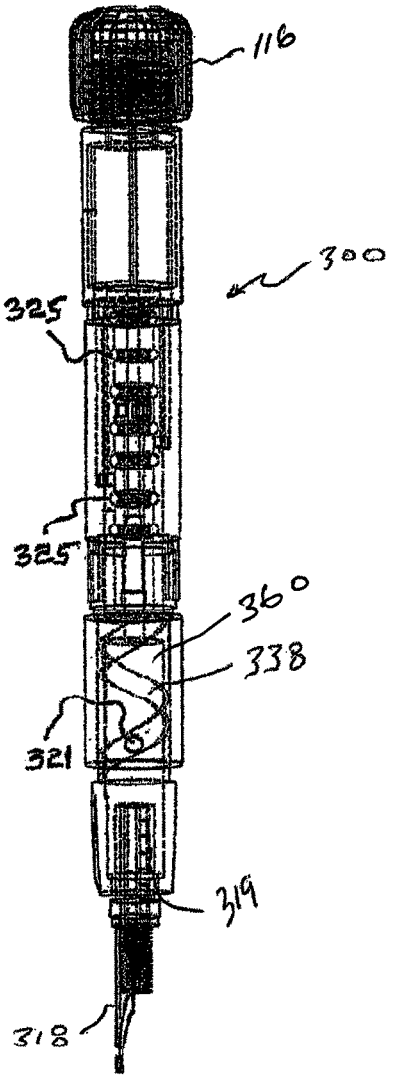
FIG. 11 is a side view of the writing instrument shown in FIG. 10 with hidden lines shown in phantom.
Figure 12:
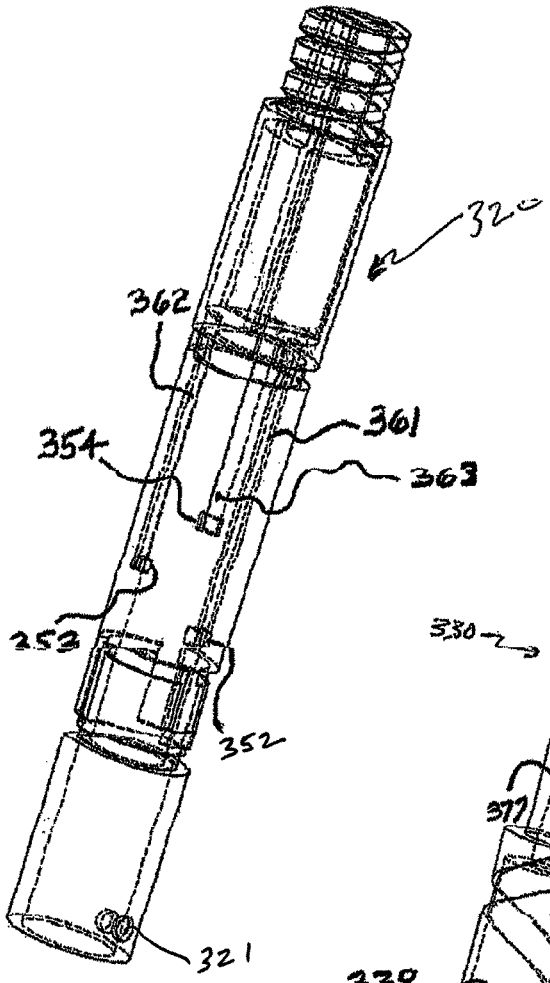
FIG. 12 is a perspective of the elongated body of the writing instrument shown in FIG. 10 with hidden lines shown in phantom.
Figure 13:
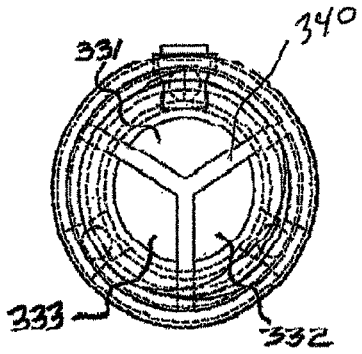
FIG. 13 is a top plan view of the body of the writing instrument shown in FIG. 12.
Figure 14:
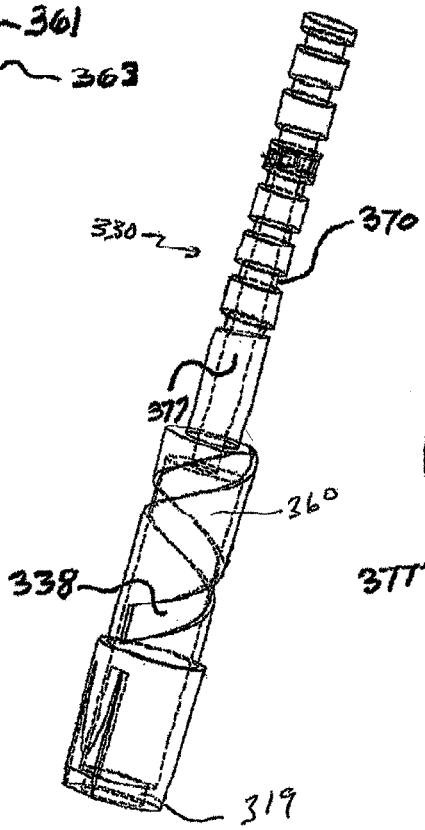
FIG. 14 is a perspective view of the spool valve of the writing instrument shown in FIG. 9 with hidden lines shown in phantom.
Figure 15:
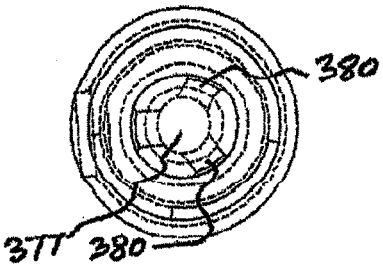
FIG. 15 is a top plan view of the spool valve shown in FIG. 14.

Directing attention now to FIGS. 8 and 9, a second embodiment of a spool valve pen is generally identified by the reference numeral 200. As evidenced by the use of common reference numerals, the pen 200 is similar to the pen 100 described above with the exception that the pen 200 may include a dual reservoir system where one or the other of the two reservoirs is always in the "on" or open mode. That is, a fluid reservoir is always in fluid communication with the pen nib 118. The pen 200 does not include an "off" mode.

In FIG. 8, the water reservoir 285 of the pen 200 is set to the "on" mode and the ink reservoir 275 is in the "off" mode. A spool valve 214 is received in the pen barrel 220 in the same manner as the spool valve 114 is received in the pen 100. The ink reservoir 275 is relatively small compared to the relatively large water reservoir 285. The ink reservoir 275 and water reservoir 285 are mounted on the spool valve 214 on opposite sides of a rigid stanchion wall 280. Both reservoirs 275, 285 may be fabricated of flexible material that facilitates quick and convenient refilling of the reservoirs 275, 285. The reservoirs 275, 285 may be refilled by pressing the flexible side of either reservoir 275, 285 against the rigid stanchion wall 280, as illustrated in FIG. 9, much like squeezing the bulb of an eye dropper, and thereby expelling any air in the reservoir. The nib 118 may then be submerged into water or ink and the like. Release of the pressure on the side of the reservoirs draws the fluid into the reservoirs. Prior to refilling a reservoir of the pen 200, a small amount of diluted writing mixture may be retained in the pen mixing chamber 160 to facilitate efficient refilling of the reservoir. The pen 200 may include additional ink reservoirs as desired, all generally being flexible reservoirs that lend themselves to the vacuum filling method described above.

The pen 200 is typically used with the water reservoir 285 in the "on" position operating as a "dilution pen" or in the "dilution" mode. The pen 200 may be operated with alcohol based inks, in which case the smaller reservoir 275 may contain alcohol ink, and the larger reservoir 285 may contain alcohol and/or a mixing solution. Additional reservoirs may be included as desired, for example, water, alcohol, and a mixing solution in separate reservoirs. Cartridges or converters known in the art may be substituted for the flexible reservoirs if desired. The selection of proper O-rings for water or alcohol use is understood, and silicon O-rings may generally suffice. An unillustrated cap or sleeve may be provided to cover the reservoirs 275, 285. Rotation of the spool valve 214 counter clockwise relative to the pen barrel 220, engages the boss 221 with helical groove 238, thereby causing the spool valve 214 to be raised and the ink reservoir 275 moved to the "on" position.

With regard to ink dilution, a user may change a color shade, or economize ink consumption. The darkness of 100× diluted ink may in many cases be as dark as lead pencil on paper, and easily reproducible with computer copiers and scanners and the like. When economizing the use of ink, and having once filled the ink reservoir 275 of the pen 200 with standard dark (nearly saturated) fountain pen ink, the user may write a hundred times more words, characters and the like with the dilution pen 200 than with use of ink alone. Ink cost savings would be notable, and the pen 200 would also be more environmentally friendly than any other pen available on the market currently.

By some estimates, when writing with a prior art medium point fountain pen with 1 cc (one cc=one ml) typical ink capacity, for example, a user may expect to write 5-15 pages of sketches or words per one cc of ink alone. With one cc of standard dark fountain pen ink in the ink reservoir 275 of the pen 200, and considering a 100*x* factor of dilution, the user may expect to write 500 to 1500 pages of sketches or written words with the dilution pen 200, which is a remarkable extension of writing. An entire book may be written without refilling the ink reservoir 275. It may also be noted that an additional advantage to diluting ink is that diluted ink dries significantly faster than a nearly saturated ink.

For further refinement of the use of a fountain pen, a user may introduce surfactants and lubricants, in powder or liquid form, to one or more pen reservoirs, at any time while using the pen. Generally, when economizing ink by providing a pen with a water reservoir, use of water soluble inks is recommended. Fountain pen inks are typically an aqueous solution and generally 92+% water, adding water is inherently compatible. If notable diminished flow or lubrication properties are evident, a drop of clear dish detergent in the water reservoir may solve flow problems and a drop of pure vegetable glycerin may solve lubrication problems. Kodak PhotoFlo may also be used as a surfactant to aid ink/water flow. TritonX-100 may be another suitable surfactant. The Triton pure chemical is concentrated and should be diluted to create a working solution, where a "working solution" of Triton X-100 may be prepared at a 1:200 dilution, and a drop of the working solution is sufficient for one fountain pen water reservoir. Use of too much surfactant may inhibit the ink/water flow. In a fountain pen, the writing fluid should optimally spread along the underside of the nib and fill in the combs in the collector. Too much surfactant and the ink solution may drip out of the nib. Use of distilled water may result in optimum results.

For use of tempera inks, where the ink viscosity is relatively thick (like honey), the spool valve may be proportionally greater in size, and have larger ink passageways and/or orifices and/or clearances. When using alcohol based inks, note that one of the pen reservoirs may be filled only with alcohol, or filled only with a "mixing solution", and the other reservoirs may be filled with alcohol based inks. Ethanol (Ethyl alcohol) is a preferred alcohol ink base.

Directing attention now to FIGS. 10-15, a third embodiment of a spool pen generally identified by the reference numeral 300 is shown. The pen 300 is similar to the pens 100 and 200 described above with the exception that the pen 300 includes reservoirs 331, 332, 333, shown in FIG. 13, and reservoir passageways 361, 362, 363, shown in FIG. 12, integrally formed with the pen barrel 320. The pen 300 may include seven O-rings 325 on the stem 365, best shown in FIGS. 11 and 13. O-rings 325 are concentrically constrained within recesses 370 of the stem 365. The lower distal ends of the passageways 361, 362, 363 are redirected radially inward at openings 352, 353, 354, respectively. An axial center passageway 377 concentric with the longitudinal axis of the stem 365 provides a conduit for the distribution of fluid, such as ink or solvent and the like, to the fluid mixing chamber 360, shown in phantom lines in the drawings, upon alignment of the stem inlet openings 380 with the passageways 361, 362, 363. Boss 321 is constrained to move along helical groove 338 thereby causing the pen barrel 320 to move axially relative to the spool valve 330 as one rotates relative to the other. Reservoirs 331, 332, 333 are isolated from each other by walls 340. An agitator such as a small metal ball may be included within each reservoir to maintain ink suspension. The blind end of the stem 365 may be vented in a similar manner as described hereinabove with reference to pens 100, 200.

The nib 318 may be screwed or press fit into a borehole 319 at the lower distal end of the spool valve 330. The upper end of the borehole 319 is open to the mixing chamber 360, shown in phantom lines in the drawings, thereby establishing fluid communication between the mixing chamber 360 and the nib 318.

While various embodiments of the invention have been shown and described herein, other and further embodiments of the invention may be devised without departing from the basic scope thereof, and the scope thereof is determined by the claims which follow.

The invention claimed is:

1. A writing instrument, comprising:

a) an elongated housing;

b) a spool valve received within said housing;

c) a writing tip secured to a lower distal end of said housing;

d) said spool valve including two or more fluid reservoirs in fluid communication with said writing tip; and e) wherein rotation of said spool valve actuates axial movement of said spool valve relative to said housing.

2. The writing instrument of claim 1 wherein said spool valve includes a head portion and an elongated stem extending downwardly from said head portion, said head portion including a helical groove formed in an outer surface of said head portion.

3. The writing instrument of claim 2 wherein said housing includes a box end configured to receive said head portion of said spool valve, said box end of said housing including an inwardly projecting boss constrained to move along said helical groove upon rotation of said spool valve relative to said housing.

4. The writing instrument of claim 2 wherein said elongated stem includes a plurality of lands axially spaced from one another, said elongated stem further including a plurality of grooves and o-rings constrained in said grooves sealingly separating said lands from one another.

5. The writing instrument of claim 4 wherein said elongated stem includes a plurality of conduits establishing fluid communication between a respective said reservoirs and a respective said lands.

6. The writing instrument of claim 5 wherein said lands include radially outwardly extending openings.

7. The writing instrument of claim 6 wherein said housing includes an axial borehole having an open upper end and a closed lower end, said axial borehole configured to receive said elongated stem of said spool valve.

8. The writing instrument of claim 1 including a mixing chamber in in fluid communication with said reservoirs and said writing tip.

9. The writing instrument of claim 7 wherein said o-rings are in sliding engagement with said axial borehole providing a fluid tight sliding seal above and below each of said lands.

10. A pen comprising:

a) an elongated cylindrical body;

b) a spool valve enclosed within said body;

c) a writing nib secured to a lower distal end of said body;

d) two or more fluid reservoirs in fluid communication with said writing nib; and e) wherein said spool valve includes a head portion and an elongated stem extending downwardly from said head portion, said head portion including a helical groove formed in an outer surface of said head portion.

11. The pen of claim 10 wherein said elongated stem of said spool valve includes a plurality of axially spaced lands and grooves and o-rings constrained in said grooves sealingly separating said lands from one another.

12. The pen of claim 11 wherein said body includes an axial borehole configured to receive said spool valve, a conduit having an upper end opening to said borehole and a lower end opening to a fluid mixing chamber proximate a lower distal end of said body, said writing nib being in fluid communication with said mixing chamber.

13. The pen of claim 10 wherein said reservoirs comprise flexible enclosures mounted on opposite sides of a rigid wall.

14. The pen of claim 10 including a plurality of conduits selectively connecting said reservoirs to a fluid mixing chamber proximate a distal end of said body.

* * * * *